US005227026A

United States Patent [19]

Hogan

[11] Patent Number: 5,227,026

[45] Date of Patent: Jul. 13, 1993

[54] RETORT HEAT EXCHANGER APPARATUS

[76] Inventor: Jim S. Hogan, 1742 Country Club Dr., Sugar Land, Tex. 77478

[21] Appl. No.: 730,011

[22] Filed: Jul. 12, 1991

Related U.S. Application Data

[63] Continuation of Ser. No. 430,731, Nov. 7, 1989, abandoned, which is a continuation-in-part of Ser. No. 384,336, Jul. 21, 1989, abandoned.

[51] Int. Cl.[5] ..... C10B 1/10

[52] U.S. Cl. ..... 202/117; 202/118; 202/136; 202/218; 202/265; 432/113; 432/116; 432/117; 432/118

[58] Field of Search ..... 202/117, 118, 131, 136, 202/218, 265, 268, 269; 432/112, 113, 115–118; 422/209, 224, 233; 110/246

[56] References Cited

U.S. PATENT DOCUMENTS

| | | | |
|---|---|---|---|
| 1,751,125 | 3/1930 | Cantieny | 202/136 |
| 1,927,219 | 9/1933 | Reed et al. | 202/131 |
| 1,944,647 | 1/1934 | Petit | 202/131 |
| 2,739,801 | 3/1956 | Rankin | 432/113 |
| 2,872,386 | 2/1959 | Aspegren | 202/136 |
| 3,142,546 | 7/1964 | Coats | 432/117 |
| 4,140,478 | 2/1979 | Kawakami et al. | 202/136 |
| 4,295,824 | 10/1981 | Wens | 432/115 |

*Primary Examiner*—Joye L. Woodard
*Attorney, Agent, or Firm*—Ned L. Conley

[57] ABSTRACT

A heat exchanger including one or more rotating drums with a freely rotating helix inside the drum to move material to be heated or cooled longitudinally through the drum, as well as to help clean the surface of the drum, together with carriers to assist in heat transfer and cleaning of the drum surface, and scoops to recycle the carriers through an inner coaxial drum. The drum has a sealed inlet and outlet disposed so that the seals are not exposed to excessive temperatures. Cooling chambers are coaxially mounted on each end of the rotating drums for cooling and condensing vapors and cooling solid particles treated in the drum. An inner drum conveys the carriers back to the starting point by means of a freely rotating helix.

12 Claims, 10 Drawing Sheets

RETORT HEAT EXCHANGER APPARATUS

RELATED APPLICATION

This is a continuation of copending application Ser. No. 07/430,731 filed on Nov. 7, 1989, now abandoned, which is a continuation-in-part of my copending U.S. patent application Ser. No. 07/384,336, filed Jul. 21, 1989, now abandoned.

FIELD OF THE INVENTION

This invention relates to the field of cooling and/or heating a material such as a gas, a liquid, or a solid that flows such as an ash, sand, or sludge, in a rotating heat exchanger. More particularly, the present invention relates to a method of cooling and/or heating a fluid in a rotating drum that utilizes one or more free rotating helixs in the drum to advance the material in the drum and carriers in the drum to exchange heat to the fluid and to clean the drum.

BACKGROUND OF THE INVENTION

Heat exchangers are well known in the art. However, many fluids cooled or heated in a normal tube exchanger cause fouling of the heat exchanger surfaces contacted by the flowing material. More specifically, when cooling liquids or gases containing hydrocarbon, the inside of a the cooling tube may foul with paraffin or other solid condensed during cooling, and when heating such gaseous or liquid materials, or solids containing such materials, the inside of the heat exchanger tubes may foul with a coke or other solid. When a normal pipe or tube exchanger fouls, the efficiency drops to a point where very little heat is exchanged to or from the flowing medium so the exchanger must be shut down and cleaned. This is a very expensive and time consuming situation, especially since, in many instances, a heat exchanger can foul in only a few hours or even minutes.

There is a significant need for heat exchangers which can be used to process such liquid, gaseous or solid materials. For example, in many petrochemical processes, by-products and waste materials are produced which must be disposed of in such a way as to avoid contamination of the environment. In some cases noxious, sometimes poisonous, gases are emitted from waste materials, so that it is necessary to prevent them from escaping. Waste materials also sometimes contain valuable materials which it is desirable to recover. Processes now being used to process such materials often have prohibitively high cost, so that there is a great need for a lower cost method of treating such materials for disposal. When solids are included among the materials to be disposed of, it is usually necessary to dry them to remove water, other liquids and noxious gases. Filter presses are now used for this purpose, but these are incapable of completely dewatering many solids, so vaporization must still be used.

In my copending application, Ser. No. 07/384,366, I have disclosed apparatus which can be used as a heat exchanger for treatment of such materials in many cases. However, a further need exists for applications which involve the application of high temperatures and require a seal to prevent the escape of noxious gases.

SUMMARY OF THE INVENTION

The present invention includes a heat exchanger comprising a rotating drum having one or more freely rotating helices rotating inside of the drum to help clean the inside of the drum. The freely rotating helices inside of the drum also advance the material, as well as carriers that are placed in the drum, and remain in the drum, to help clean the inside of the drum and to help transfer heat to or from the material being heated or cooled. Means are provided to isolate the seals from the high temperature area of the heat exchanger, and to insure that noxious gases cannot escape to the atmosphere. The use of the carriers insures that solids are continually removed from heat exchanger surfaces, pulverized, and removed, so that efficient heat transfer is maintained.

It is therefore an object of the present invention to provide an improved heat exchanger having minimal fouling characteristics and improved heat transfer characteristics.

It is also an object of the present invention to provide a rotating heat exchanger with an inlet and an outlet, but requiring only one seal between the rotating exchanger and the non-rotating inlet and outlet.

Another object of the present invention is to provide a single rotating heat exchanger that has a mid-section that serves as a retort for heating a solid and liquid and vaporizing the liquid, a front section for cooling, condensing, and removing the vapors from the mid-section, and a rear section for cooling and removing the hot solids from the mid-section.

It is still another object of the present invention to provide a sealed heat exchanger for working in a hot service that includes a rotating drum, a non-rotating inlet, a non-rotating outlet for removing the solids from the drum, and a non-rotating outlet for removing the vapors from the drum, but the seals between the rotating and non-rotating parts are working in a cold service.

Accordingly, heat exchangers for the heating and/or cooling are disclosed utilizing one or more drums and one or more freely rotating helices that advance the material in the drum or drums from the inlet to the outlet of the exchanger. In one embodiment, the exchanger includes one rotatable drum having disposed therein carriers that move freely on the bottom of the drum to clean the inside of the drum, transfer heat to or from the fluid being heated or cooled, to or from the walls of the rotating drum, and to advance the material from the inlet to the outlet of the drum.

In another embodiment, the exchanger includes a rotatable exterior cylindrical drum and an interior cylindrical drum being coaxially disposed in the exterior drum to form an annular passage between the two drums. The front end of the exterior drum is closed by an annular plate having an inlet tube connected to the center of the annular plate and an opening in the center of the annular plate such that there is a passageway from the inside of the exterior drum through the tube and to the outside of the exterior drum. The tube is rotatably supported on bearings and sealingly engaged by a seal, the bearings and seal being mounted on a stationary inlet pipe such that the tube, bearings, seal, and exterior drum rotate around the inlet pipe. Therefore, material can flow through the inlet pipe and through the inlet tube to the inside of the rotating drum but the seal between the tube and the inlet pipe prevents flow from the inside of the rotating drum to the outside of the rotating drum and the outside of the inlet pipe.

The back end of the exterior drum is also closed by an annular plate having a passageway in the center thereof and an outlet tube with bearings and a seal that, in turn, are mounted on a stationary outlet pipe such that the exterior drum, bearings, seal and outlet tube rotate around the outlet pipe and the outlet pipe does not rotate. The interior drum is attached integrally to the exterior drum by rods so that the interior drum rotates together with the rotatable exterior drum. Therefore, material can flow through the outlet tube and through the outlet pipe from the inside of the rotating drum but the seal between the outlet tube and the outlet pipe prevents flow from the inside of the rotating drum to the outside of the rotating drum and the outside of the outlet pipe.

Each end of the interior drum is attached integrally to the exterior drum by rods so that the interior drum rotates together with the rotatable exterior drum. The interior drum is located between the back end annular plate and the front end annular plate of the exterior drum so that there is a first space between the annular plate of the front end of the exterior drum and the front end of the interior drum and a second space between the annular plate of the back end of the exterior drum and the back end of the interior drum.

A carrier scoop is located in the second space and extends from the interior surface of the exterior drum to the inside of the back end of the inside drum to convey carriers from the interior surface of the exterior drum in the second space to the interior of the interior drum. This carrier scoop has selected openings to contain the carriers and direct them to the interior of the interior drum, but not to contain the flowing medium being cooled or heated.

A material scoop is located in the second space and extends from the interior surface of the exterior drum to the inside of the outlet pipe to convey the material being heated or cooled from the interior surface of the exterior drum in the second space to the interior of the outlet pipe. This material scoop has selected openings to contain the material and direct it to the inside of the outlet pipe, but not to allow the carriers to flow to the outlet pipe.

A third scoop may, alternatively, be placed next to the carrier scoop to convey a selected portion of the material to the inside of the interior drum, for recirculating a selected portion of the material.

A ring is disposed between the first space and the front end of the annular passage to prevent excessive amounts of carriers from flowing from the first space and the front end of the annular passage, and a scoop is provided in the first space, through the ring, and into the front end of the annular passage to allow a selected amount of carriers to flow from the first space to the front end of the annular passage.

A freely rotatable helix is disposed in the annular passage and between the rods on each end of the interior drum and rotates freely therein, as the two drums rotate. The helix is helixly configured to advance the carriers and the material from the front end of the exterior drum to the back end of the exterior drum. Another freely rotatable helix is disposed in the interior drum and rotates freely therein as the two drums rotate. The other helix is helixly configured to advance the material in the interior drum from the back end thereof to the front end thereof.

Sometimes the outside of the interior drum cokes and collect an excessive amount of solids. To prevent this, an additional helix is placed on the outside of the interior drum and rides and rotates thereon. This additional helix rotates inside of the larger helix in the exterior drum and does not touch the larger helix or the exterior drum.

In operation, feed material to be cooled flows through the inlet pipe to the first space in the exterior drum. A cooling medium is passed around the outside of the exterior drum. The material being cooled flows from the first space in the exterior drum, through the annular passage between the exterior drum and the interior drum to the second space in the exterior drum, and then is scooped up and placed inside of the outlet pipe.

As the exterior and interior drums rotate as one piece, and the free rotating helices rotate freely, carriers flow from the first space, through the annular passage to the second space and then they are lifted up by the carrier scoop and placed in the back side of the interior drum. They then flow from the back end of the interior drum to the front end of the interior drum and are returned to the first space. Not only is the hot material being exposed to the cold interior of the exterior drum, but the hot material is also exposed to the helices, inside drum, and the carriers which convey heat from the hot material to the interior of the exterior drum.

The inside of the exterior drum and the inside and outside of the interior drum are being cleaned continuously by the carriers and/or helices that rotate freely with the rotating drums.

Heating a material in the exchanger is the same as cooling a material except that a heating fluid, rather than a cooling fluid, is passed around the outside of the exterior drum.

The exterior drum may contain fins on the outside thereof to aid in the transfer of heat between the fluid outside of the drum and the outside surface of the outside drum. Also, a jacket may be placed around the outside of the outside drum to contain the heating or cooling fluid.

Additionally, a container of water or cooling liquid may be placed under the outside of the exterior drum so that fins can dip into the liquid as they rotate to further cool the fins and drum. The fins can have scoops or cups to lift the liquid up and splash the liquid on the top of the rotating exterior drum, eliminating the need for a pump as utilized in conventional cooling towers.

On small exchangers, the present invention also teaches how the feed and cooled or heated product can pass through the same end of the exchanger where only one seal is required which provides lower construction and maintenance costs.

In another embodiment, the exterior drum is divided into three sections, each section being similar to the second exchanger described. The outside of the midsection is heated with a heating medium for vaporizing liquids and heating solids that pass therethrough. The outside of the front section is cooled with a cooling medium for condensing the vapors and cooling the liquids condensed therefrom. The outside of the back section is cooled with a cooling medium to cool the solids, after the liquids have been removed from the solids and before the solids are removed from the exchanger.

In this other embodiment, it is also taught how vapors can be removed from both ends of the exchanger and condensed and cooled.

BRIEF DESCRIPTION OF THE DRAWINGS

For a detailed description of the preferred embodiments of the present invention, reference will now be made to the accompanying drawings wherein.

DESCRIPTION OF THE PREFERRED EMBODIMENTS (a) Rotating Exchanger with the Feed on the Front End and the Product on the Rear End.

Figure 1:
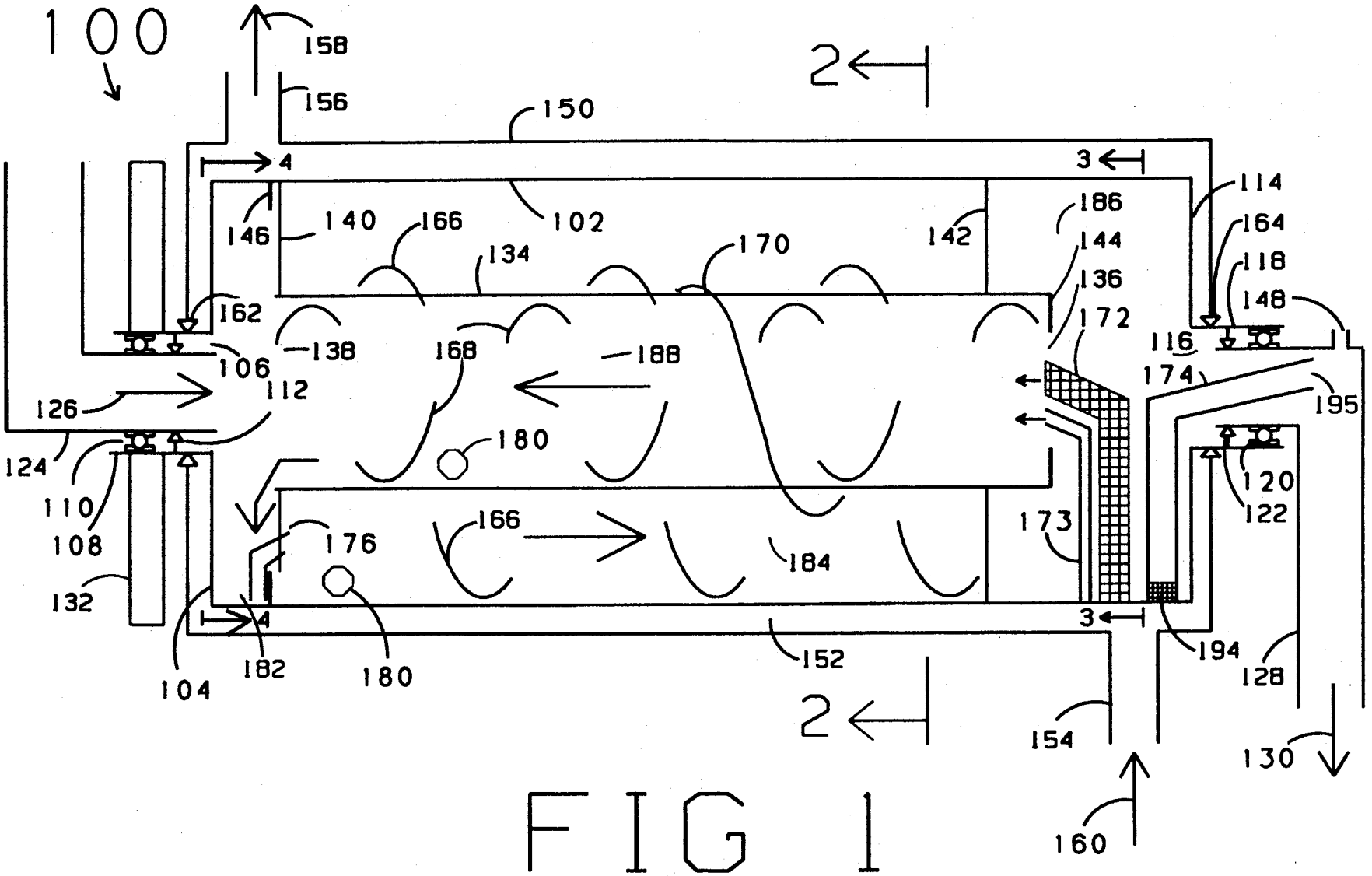
FIG. 1 is a schematic vertical sectional view of a heat exchanger according to the present invention.

Referring now to FIG. 1, there is shown exchanger 100 having a horizontal rotating drum 102. The front end of drum 102 (the left end as shown in the drawing) is closed by circular plate 104 which has a center opening 106 which receives the inner end of tube 108, which functions as a support axle for the drum. A bearing 110 and seal 112 are mounted within tube 108, the bearing rotatably supporting inlet pipe 124, and the seal also sealingly engaging inlet pipe 124.

The rear end of drum 102 is closed by circular plate 114 which has center opening 116 with support tube 118 surrounding the opening. The inside of tube 118 has bearing 120 and seal 122 mounted therein, the bearing 120 rotatably supporting outlet pipe 128 and the seal sealingly engaging the outlet pipe.

Drum 102 is enclosed by jacket 150 that provides an annular chamber 152 between jacket 150 and drum 102. Jacket 150 is provided with inlet tube 154 at the bottom near one end, and an outlet tube 156 at the top near the other end. Seal 162 provides a seal between jacket 150 and tube 108, and seal 164 provides a seal between jacket 150 and tube 118.

An interior cylindrical drum 134 is coaxially disposed within drum 102 to form an annular passage 184 between drum 102 and drum 134. Rods 140 attach the outside of the front end of drum 134 to the inside of drum 102 and rods 142 attach the outside of the rear end of drum 134 to the inside of drum 102 so that drum 134 rotates With drum 102. Drum 134 has an opening 138 on the front end and an annular ring 144 forming an opening 136 in the rear end.

Typical carriers 180 are shown on the bottom inside of drums 102 and 134. The carriers are objects made of steel or stone which are small enough to flow between the helices and the chambers of the exchanger but large enough to effect a cleaning of the walls of the drums and a crushing and grinding of material that sticks to the walls of the drums. However, it has been found that the carriers should not have a circular cross-section, since circular carriers will roll along the inside walls of the drums. Instead, the carriers preferably have flat or irregular sides so they will slide, tumble, and scrape the drum walls. One suitable shape is hexagonal, like a blank for a nut.

Drum 102 carries within it a freely rotating helix 166 with an axis parallel to drum 102. The helix has a diameter such that ,it rests on the bottom inside of drum 102 and passes around the outside of drum 134 but does not touch drum 134. Helix 166 is located between rods 140 and 142 and is allowed to rotate freely inside drum 102 as drum 102 rotates. Rotating helix 166 is configured to move material which rests on the bottom inside of drum 102 from the front end to the rear end of drum 102.

Helices in the present invention are helical rods or bars that are formed like a coil compression spring. The operation of the helices in the present invention is more fully taught in my copending patent application Ser. No. 07/384,336, filed Jul. 21, 1989.

Inside of drum 134 is a freely rotating helix 168 that touches the bottom inside of drum 134 and is allowed to rotate freely inside of drum 134 as drum 134 rotates. Rotational helix 168 is configured to move material from the rear end of drum 134 to the front end of drum 134.

A cleaning helix 170, having a larger diameter than drum 134, rests on the outside of drum 134 and between rods 140 and 142. Rotation of drum 134 causes cleaning helix 170 to rotate, but it is loose on drum 134, so that it slides and scrapes the outside of the drum. Cleaning helix 170 has a cross-section which includes a scraping face on one side, for example as may be formed by a rectangular or triangular cross-section.

Figure 2:
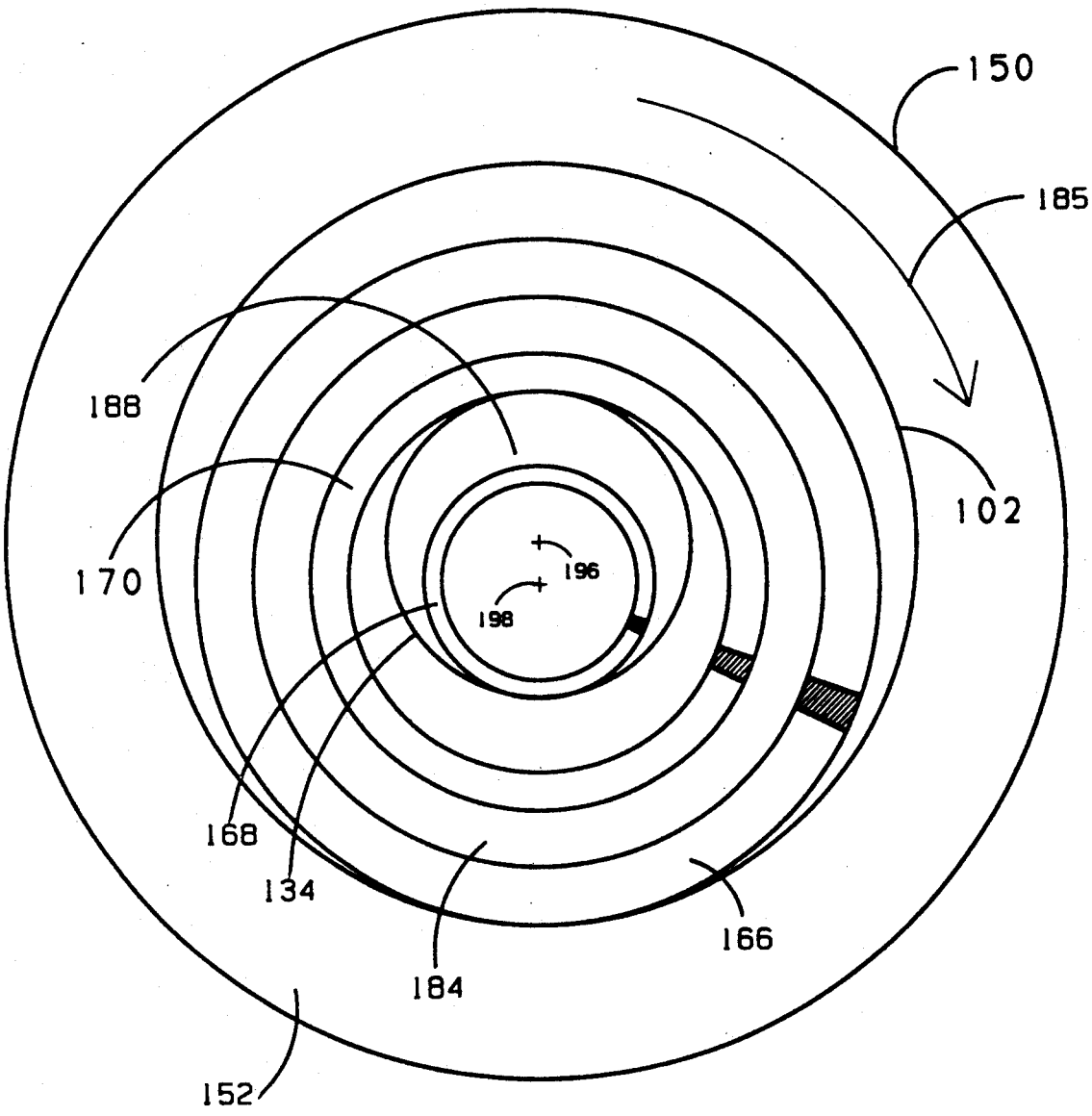
FIG. 2 is a cross-section of the apparatus of FIG. 1 taken along the plane shown by line 2—2 in FIG. 1.

Referring now to FIG. 2, there is shown a cross-section of exchanger 100 along line 2—2 of FIG. 1. There is shown rotatable drum 102 enclosed by fluid jacket 150 providing annular chamber 152. Drum 134 is held rigidly in the center of drum 102 by rods 142 which are attached to the inside of drum 102 and the outside of drum 134. Helix 168 is shown on the inside of drum 134 and helix 170 is shown on the outside of drum 134 and riding the top outside wall of drum 134. Helix 166 is shown inside of drum 102 and lying on the bottom inside wall of drum 102. Drums 102 and 134 rotate in the center of jacket 150 and around center 196, while helices 166, 168, and 170 rotate around a different center as indicated by 198 of FIG. 2. It can be seen that helices 166, 168, 170, and drum 134 rotate when drum 102 rotates and that cleaning helix 170 rides on the outside wall of drum 134 and rotates therewith but does not touch helix 166 or drum 102.

Referring back to FIG. 1, an annular ring 146 positioned on the inside front portion of drum 102 partially closes the front end of the annular passage 184 between the rods 140 and the front end plate 104 and provides chamber 182 in the inside front end of drum 102. There is also a rear end chamber 186 on the inside rear end of drum 102 that is located between rods 142 and rear end plate 114.

Carrier scoop 172 is positioned in chamber 186 and is affixed to the inside of drum 102 and extends to the inside of drum 134 through opening 136. The walls of carrier scoop 172 are perforated to allow liquids and small solids to pass through them, but the perforations are smaller than the carriers so that the carriers will not pass through the walls but are lifted up and placed in the inside of drum 134 as drum 102 rotates. Material scoop 174 positioned in chamber 186 is attached to the inside of drum 102 and extends through opening 116 to the inside of outlet pipe 128. Inlet opening 194 of scoop 174 is perforated so that liquids and small solids can pass through the perforations but the carriers cannot and so that liquids and small material are lifted up and placed inside of pipe 128 as drum 102 rotates.

Optionally, for liquids, scoop 173 is located in chamber 186 and attached to the inside of drum 102 and extends alongside of scoop 172 to the inside of drum 134 through opening 136. Scoop 173 is optionally provided for use when exchanger 100 is used as a condenser and it is desirable to cool drum 134 by keeping the inside wetted with condensate.

Figure 3:
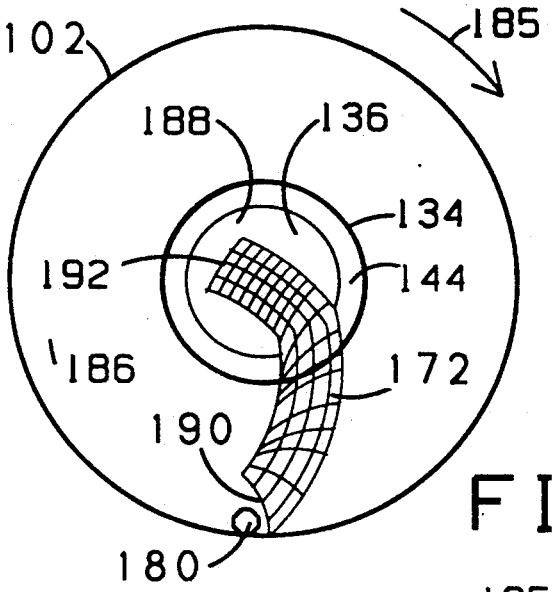
FIG. 3 is a cross-sectional schematic of the apparatus of FIG. 1 taken along the plane shown by line 3—3 in FIG. 1, showing the apparatus in one position.

FIG. 3 shows a cross-section of exchanger 100 along line 3—3 of FIG. 1. Scoop 172 extends from the interior surface of drum 102 to opening 136 of ring 144 which is attached to the interior of drum 134. Helices 166, 168, 170, and rods 142 are not shown in FIG. 3. Scoop 172 is a tube fabricated from wire mesh or perforated steel which has a multitude of openings to let liquid and small particles pass through the holes or perforations in scoop 172 but does not let the carriers pass through the openings. Scoop 172 has an inlet opening 190 on the front end of scoop 172 next to the inside wall of drum 102 to let the carriers enter the scoop and an outlet opening 192 on the rear end of scoop 172 inside of chamber 188 to let the carriers depart from the scoop inside of ring 144 and chamber 188. Ring 144 is provided to prevent the carriers from falling back into chamber 186 before helix 168 (shown in FIGS. 1 and 2) inside of drum 134 can move the carriers down drum 134. FIG. 3 shows drum 102 rotated such that the inlet end of scoop 172 is on the bottom of drum 102 and typical carrier 180 is about to enter scoop 172 through inlet opening 190 as drum 102 rotates further.

Figure 3A:
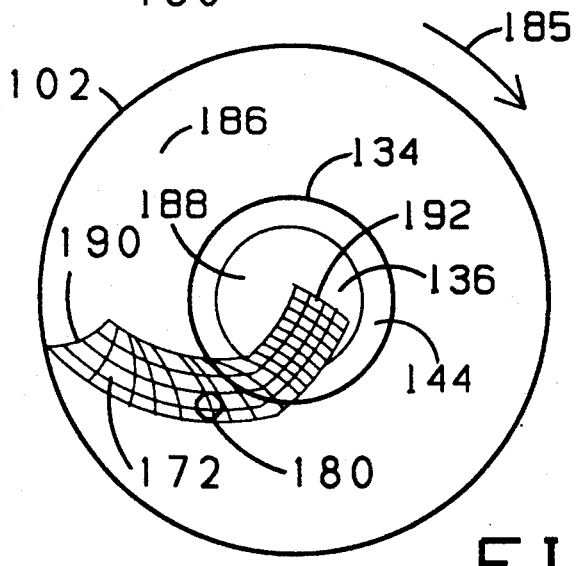
FIG. 3A is a cross-sectional schematic of the apparatus of FIG. 1 taken along the plane shown by line 3—3 in FIG. 1 showing the apparatus following a ninety-degree rotation from the position shown in FIG. 3.
Figure 3B:
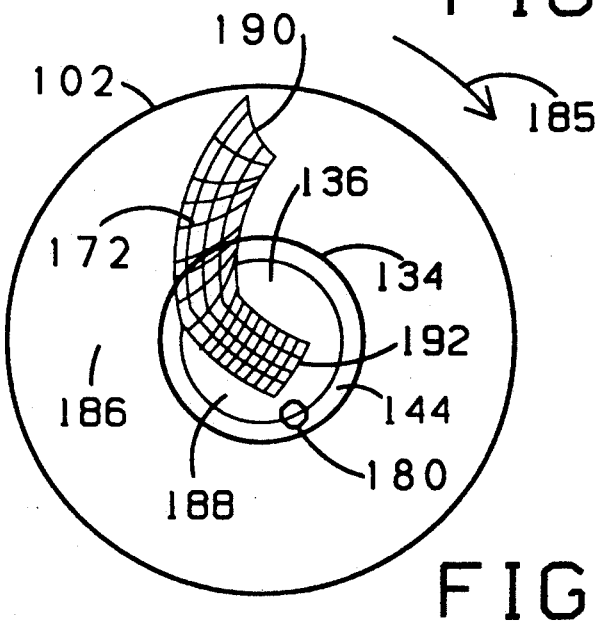
FIG. 3B is a cross-sectional schematic of the apparatus of FIG. 1 taken along the plane shown by line 3—3 in FIG. 1 showing the apparatus following a one hundred and eighty degree rotation from the position shown in FIG. 3.

FIGS. 3A and 3B depict a schematic of the cross section of the exchanger shown in FIG. 3 after one-quarter (ninety-degrees) and one-half (one hundred eighty degrees) rotation, respectively, showing the progress of the carriers 180 being conveyed from drum 102 into drum 134 by scoop 172 through opening 136, as drums 102 and 134 rotate clockwise. It can be seen in FIG. 3A that liquids and small solid particles pass through the perforations of scoop 172 back to drum 102, but that the carriers are larger than the perforations and remain in scoop 172 until they leave scoop 172 through outlet opening 192.

Referring now back to FIG. 1, reference is made to scoop 174, which is similar to scoop 172, except that it does not have perforations so that it contains liquids and small solid particles and is configured so that the liquid and solid particles depart scoop 174 through opening 195 inside of outlet pipe 128. The inlet opening 194 of scoop 174 is restricted with openings smaller than the carriers so that the carriers cannot enter scoop 174 and therefore remain in exchanger 100. The restrictions in inlet opening 194 also function as a particle sizing device to restrict large lumps from leaving the exchanger and keeping them in the exchanger until they have been further ground or pulverized in chambers 182 and 186. Alternate scoop 173 may be used, if desired, when exchanger 100 is used as a condenser. Scoop 173 is configured like scoop 172 except that it does not have perforations and is sized so that a selected amount of liquid, if desired, is lifted from drum 102 and placed inside of drum 134 to wet and cool the inside of drum 134.

Scoop 176 is provided in chamber 182 to lift a selected amount of carriers and material over ring 146 and to chamber 184.

Vapor outlet 148 is provided in pipe 128 so that Vapors can be removed from exchanger 100, separately from the solids, when exchanger 100 is used to heat solids and vaporize liquids therefrom.

Driving wheel 132 is attached to tube 108 for rotating drum 102. Wheel 132 can be connected to a driver by a belt, chain, or gear arrangement. The driver and connection are not shown, it being understood that they can be provided by one skilled in the art.

As seen from the above description, drum 102 is integrally attached to scoops 172, 173, 174, and 176, ring 146, drum 134 by rods 140 and 142, tubes 108 and 118 by end plates 104 and 114, and to drive wheel 132 by end plate 104 and tube 108, so that those components rotate together as one piece, as the external driving means (not shown) rotate drum 102 by rotating wheel 132. The front end of drum 102 is supported by bearing 110 carried in tube 108. Bearing 110 is mounted on inlet pipe 124 which is supported externally (support not shown). The rear end of drum 132 is supported by bearing 120 carried in tube 118. Bearing 120 is mounted on outlet pipe 128 which is supported externally (support not shown). As drums 102 and 134 rotate, free helices 166, 168, and 170 rotate, respectively, as previously described, but inlet pipe 124, outlet pipe 128, and fluid jacket 150 do not rotate.

In the operation of exchanger 100 as a condenser, hot vapors enter drum 102 through pipe 124. Drum 102 is cooled by cold gaseous fluid in chamber 152 on the outside of drum 102, causing vapors to condense and, in some cases, solids to deposit on the walls of the drum. The cold fluid enters chamber 152 by inlet pipe 154 and exits chamber 152 by outlet pipe 156. Helices 166 and 170 rotate as drums 102 and 134 rotate, crushing deposited solids, such as paraffin, and helix 166 conveys the solids and the carriers to the chamber 186 at the right end of drum 102. The tumbling carriers crush and scrape solids from the wall of the drum. Rotating drum 102 causes scoop 176 to lift carriers 180 and material from chamber 182 and over ring 146 to chamber 184. Helix 166 is wound so that it pushes the carriers through chamber 184 to chamber 186 where they are lifted by scoop 172 to inside of drum 134. Helix 168 is wound so that it then pushes the carriers from opening 136 through chamber 188 and back to chamber 182 through opening 138. The liquid that condensed from the hot vapors, the carriers, and helix 166 are cooled by the inside wall of cool rotating drum 102. Drum 134 is cooled by radiating heat to the walls of drum 102 and by radiation and convection to the carriers and liquid that moves through the inside of drum 134 from scoops 172 and 173. The hot vapors are cooled and condense on the surfaces of the inside wall of drum 102, the inside and outside walls of drum 134, the surfaces of helices 166, 168, and 170, and the carriers. The liquid that condenses from the hot vapors is then lifted from drum 102 by scoop 174 to outlet pipe 128 where it is removed. Carriers 180 clean the walls of solid particles which are removed from exchanger 100 with the liquid.

The entire operation of exchanger 100 takes place in a sealed container, since seals 112 and 122 prevent any gases, liquids, or solids inside of drum 102 from escaping to the outside.

When exchanger 100 is used as a heater, the operation is essentially the same as described above except hot gaseous fluid is used to heat drum 102, instead of cold fluid. When a solid is being heated in exchanger 100, carriers 180 tend to serve as mullers and grind and pulverize the solid feed in chamber 182 as well as during the movement of the material along the bottom of the drum 102. Carriers in chamber 182 begin to transfer heat to the solid material at this point, and some vaporization may occur. As the drum 102 rotates, scoop 176 transfers a mixture of solids and carriers over the ring 148, and deposits it in the chamber 184, where it is gradually moved to the right by the helix 166, the rolling of the helix and the tumbling of the carriers serving to crush the solids while they are being heated by heat exchange with the wall of the drum 102, resulting in liquifaction and vaporization of some components. In chamber 186, some of the carriers and larger pieces of solid material are picked up by scoop 172 and deposited into inner drum 134, where they are conveyed to the left by the helix 168, and deposited into chamber 182 for recirculation. During the passage through drum 134, the solids are further pulverized and dried.

Liquids and small solid particles resulting from the heat exchange may be removed by scoop 174, which deposits them in outlet pipe 128. Vaporized materials may exit by pipe 148. If desired, scoop 173 may be used to recirculate some of the liquid and small solid particles.

It has been found that the carriers tend to spread out in chamber 182, and that when drum 102 is only twenty inches in diameter, the carriers will spread out to a length of three to five feet along the bottom of the drum, depending on the rotational speed of drum 102 and the size of the carriers. Thus, in a relatively short drum, helix 166 may not be needed. Also, when heating a solid containing a liquid, scoop 173 is not necessarily required and the vapors vaporized from the solid can be removed by pipe 148 while the solids and unvaporized liquid are removed by gravity through pipe 128.

Figure 4:
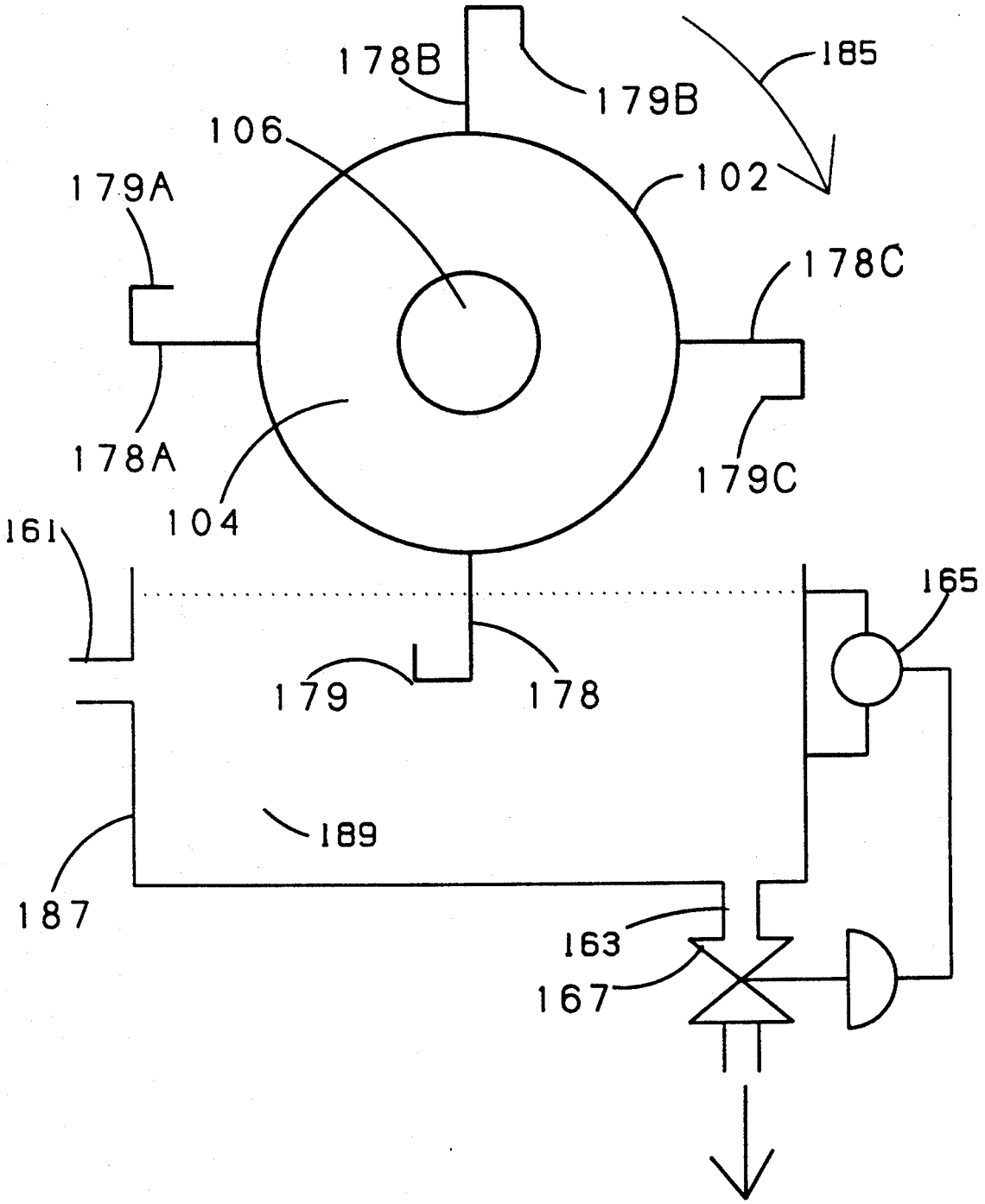
FIG. 4 is a schematic vertical sectional view of an apparatus for supplying a cooling medium to the present invention.

Referring now to FIG. 4, there is shown a cross section of condenser 100 along line 4—4 of FIG. 1 showing drum 102 and plate 104. Jacket 150 of exchanger 100 of FIG. 1 has been removed from exchanger 100 of FIG. 4, it being understood that in some instances, when using exchanger 100 as a cooler, drum 102 can be sufficiently cooled by the ambient air. Fins 178, 178A, 178B, and 178C have been added to the outside surface of drum 102 to provide more surface for cooling drum 102. If the ambient air does not provide enough cooling, container 187 is provided to hold water, or a cooling liquid 189 under drum 102 so that fins 178, 178A, 178B and 178C can dip into liquid 189 as drum 102 rotates. Container 187 may also be raised so that the outside surface of drum 102 is in liquid 189. Fins 178, 178A, 178B, and 178C can also be provided with scoops, or cups, 179, 179A, 179B, and 179C, to lift the liquid from container 187 and spill the liquid on the top of drum 102 as drum 102 rotates. Cold liquid is added to container 187 through pipe 161 and excess liquid is removed through pipe 163 with the liquid level in container 187 being controlled by liquid level controller 165 that controls valve 167.

(b) Exchanger Requiring Only One Seal.

Figure 5:
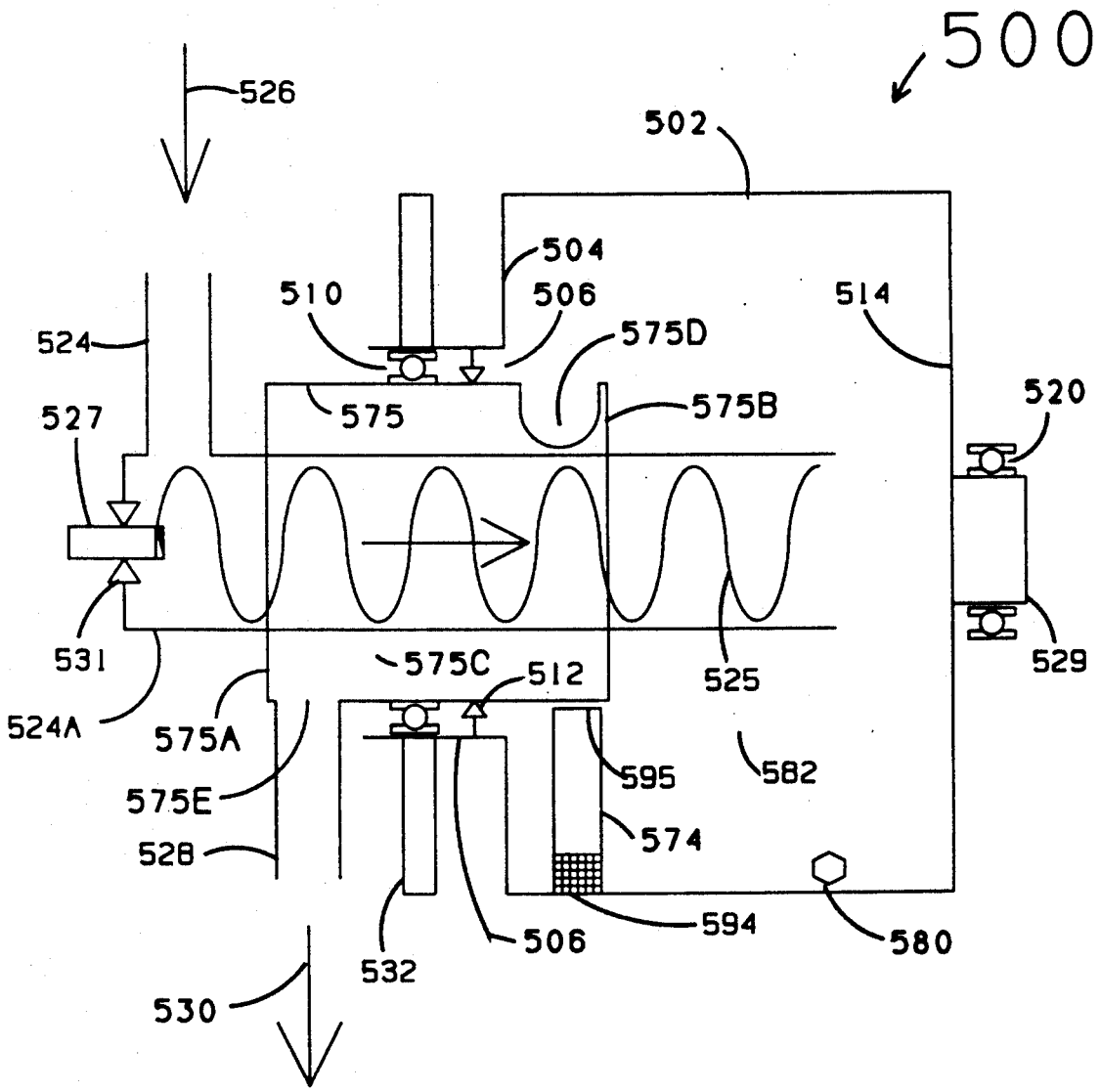
FIG. 5 is a schematic vertical sectional view of another embodiment of the heat exchanger according to the present invention.

Referring now to FIG. 5, there is another version of the exchanger of the present invention which requires only one seal for both the feed and the outlet. FIG. 5 shows exchanger 500 having rotatable drum 502. The front end of drum 502 is enclosed by front end annular plate 504 having center opening 506. Tube 508 is connected to plate 504 around opening 506. Collection tube 575, having inlet opening 575D within drum 502, is concentrically received within opening 506, and has bearing 510 and seal 512 mounted thereon, with the bearing rotatably engaging tube 508 and the seal providing a seal between tube 508 and collection tube 575. Outlet pipe 528 is connected to collection tube 575 at opening 575E. End plates 575A and 575B close the front and rear ends, respectively, of tube 575. Feed tube 524A is concentrically mounted in collection tube 575, and extends from beyond the front end of the collection tube to within the drum 502, forming an annular chamber 528A between tubes 575 and 524A. Inlet pipe 524 is connected to the front end of inlet tube 524A. The rear end of drum 502 is enclosed by circular plate 514, and is mounted on shaft 527, which is supported on bearing 520. A drive wheel 532 is attached to tube 508 for rotating drum 502. Again, driving means for rotating wheel 532 and drum 502 is not shown. A feed screw 525 is concentrically mounted within tube 524A, and extends from the front end to the rear end. At the front end it is attached to drive shaft 527, (driver not shown) and drive shaft 527 is provided with seal 531. When exchanger 500 is used as a condenser, screw 525 with drive shaft 527 with driver and seal 531 are not required. Scoop 574 is affixed to the inside of drum 502 near its forward end and is constructed and positioned so that it passes over opening 575D as drum 502 rotates, so that materials scooped up are deposited in opening 575D. Carriers 580 are placed inside of drum 502, and the openings in the inlet 594 of scoop 574 are small enough to prevent carriers from entering scoop 575 and lifted to opening 575D.

It can be seen therefore that the rotation of drive wheel 532 rotates drum 502 and scoop 574, but that inlet tube 524A, and collection tube 575 are stationary. As drum 502 rotates, carriers 582 roll, tumble and scrape along the inside bottom of drum 502 to keep the inside walls clean.

In operation of the exchanger 500 shown by FIG. 5, drum 502 is rotated by wheel 532 (driver not shown) and the outside temperature of drum 502 is maintained by methods previously taught. Feed is passed to chamber 582 in drum 502 by inlet pipe 524 and inlet tube 524A. After heat has been exchanged between the feed and the inside walls of drum 502, the product is lifted by scoop 574 from the bottom of drum 502 to opening 575D and then flows to outlet pipe 528 through collection tube 575. Solids that deposit on the inside walls of drum 502 are removed by carriers 580 and are picked up by scoop 574 and carried out through outlet pipe 528.

It can therefore be seen that, when using exchanger 500 as a condenser, screw 525 with shaft 527 and driver and seal 531 is not required and that if bearing 510 is large enough, bearing 520 and shaft 527 are also not required. Therefore, exchanger 500 makes a very economical exchanger in a fouling condensing service.

(c) An Exchanger Having a Mid-section for Heating a Solid and Vaporizing the Liquid from the Solid, a Front Section for Condensing the Vapors from the Mid-section, a Rear Section for Cooling the Hot Solids from the Mid-section, and Means for Separately Removing the Cooled Solids, Liquids, and Non-condensable Gas from the Exchanger.

Figure 6:
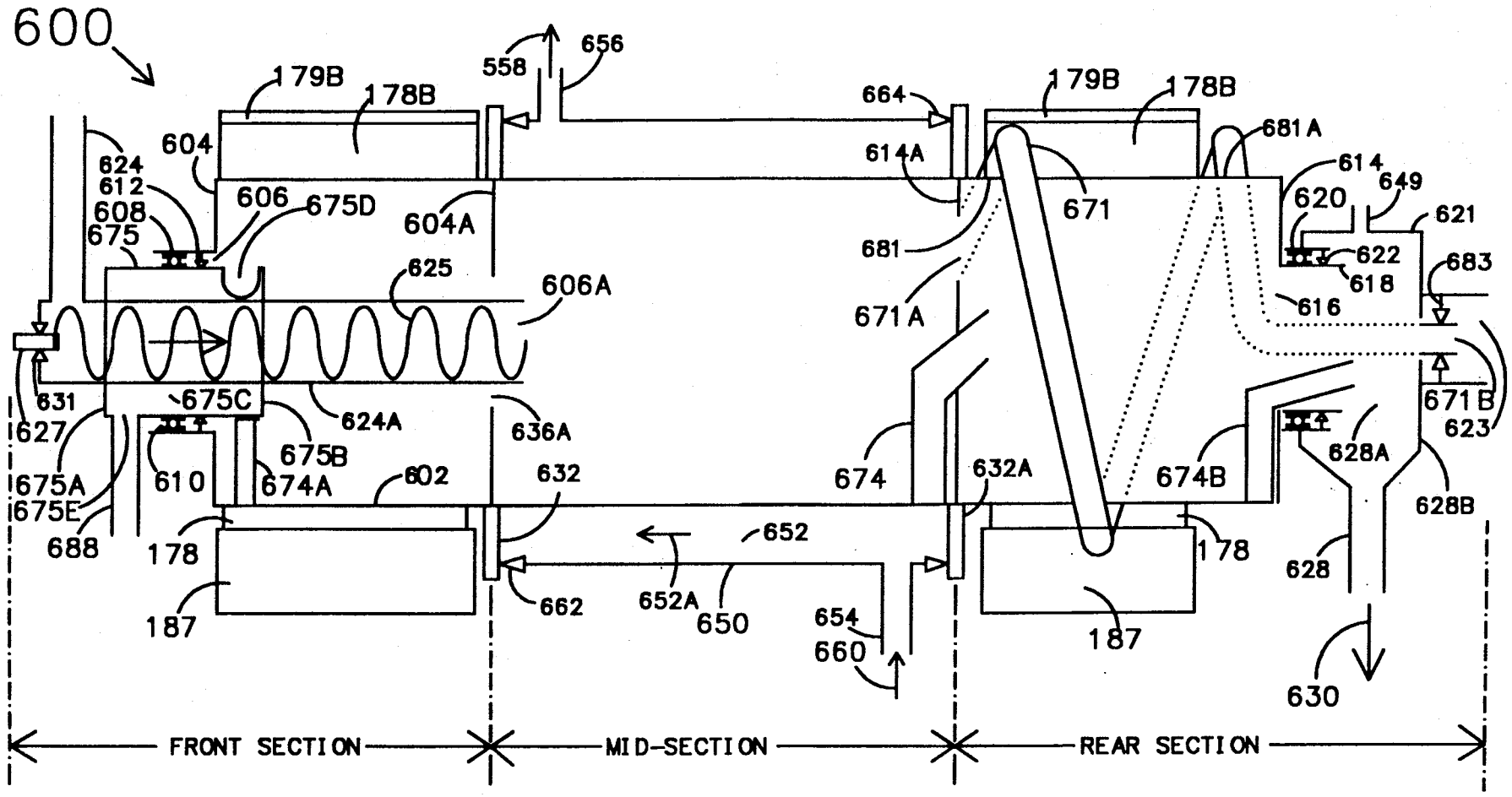
FIG. 6 is a schematic vertical sectional view of still another embodiment of the heat exchanger according to the present invention.
Figure 7:
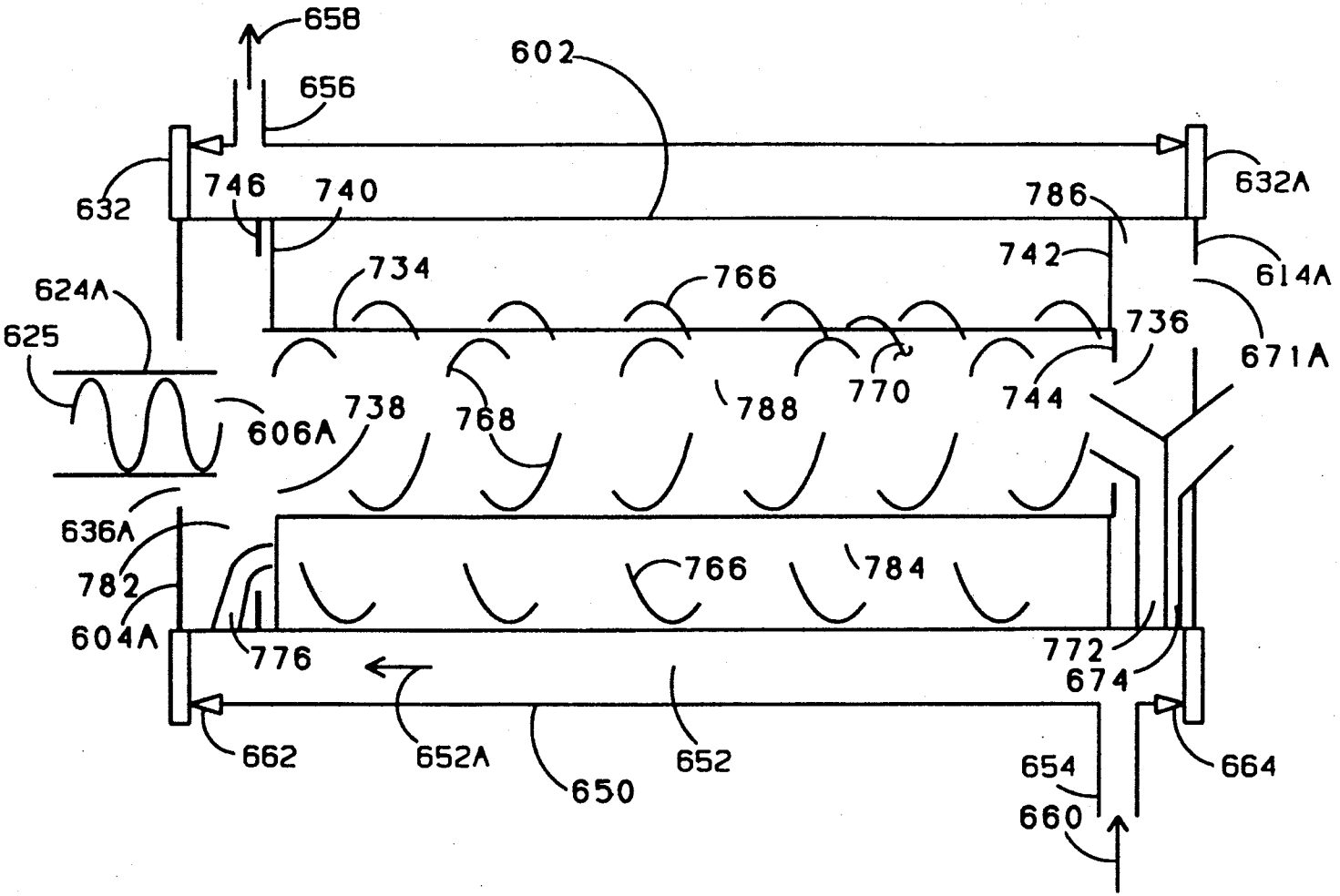
FIG. 7 is a cross-sectional schematic of the mid-section of the apparatus of FIG. 6 that shows the mid-section of FIG. 6 in more detail.
Figure 8:
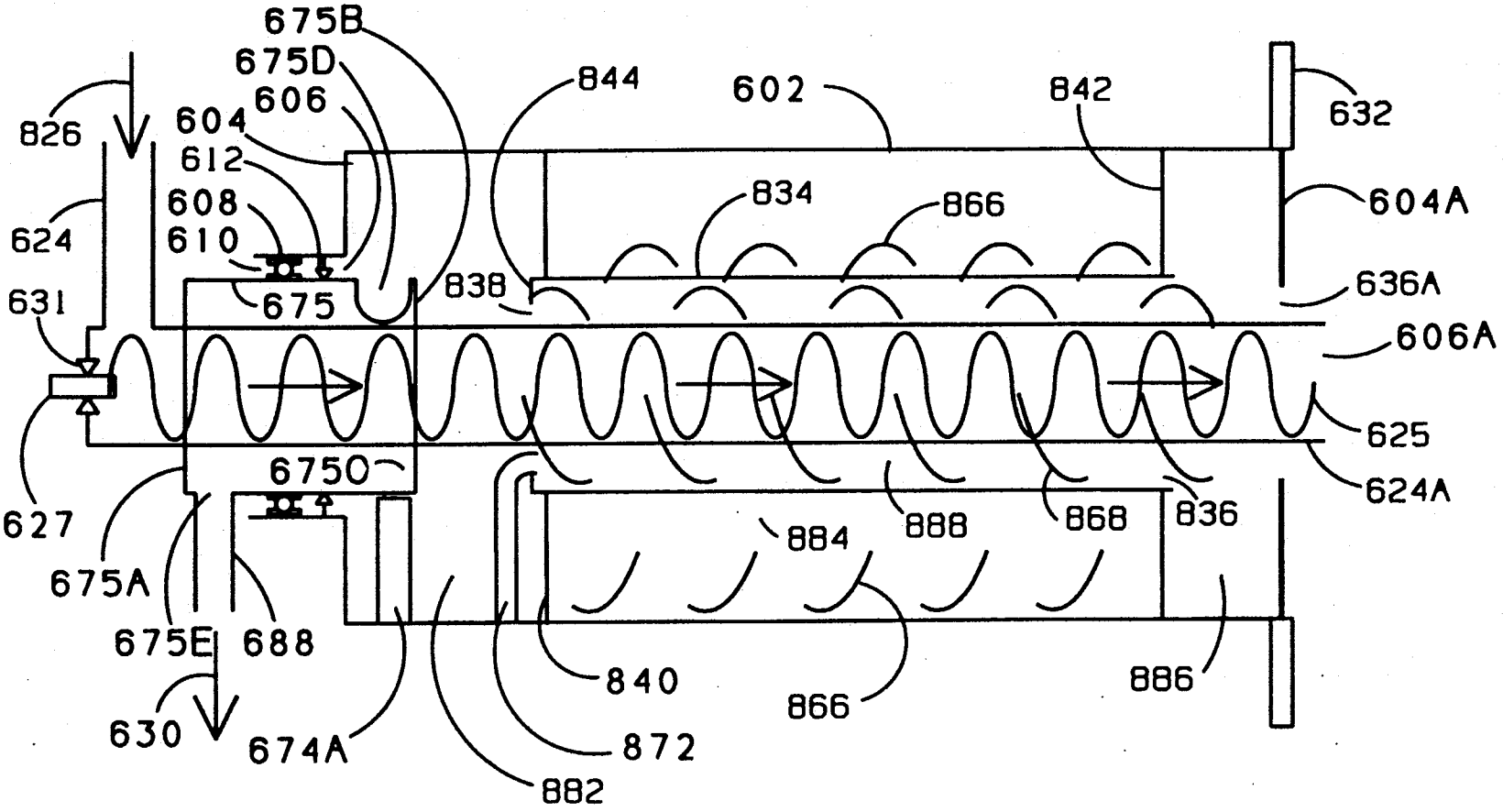
FIG. 8 is a cross-sectional schematic of the front section of the apparatus of FIG. 6 that shows the front section of FIG. 6 in more detail.
Figure 9:
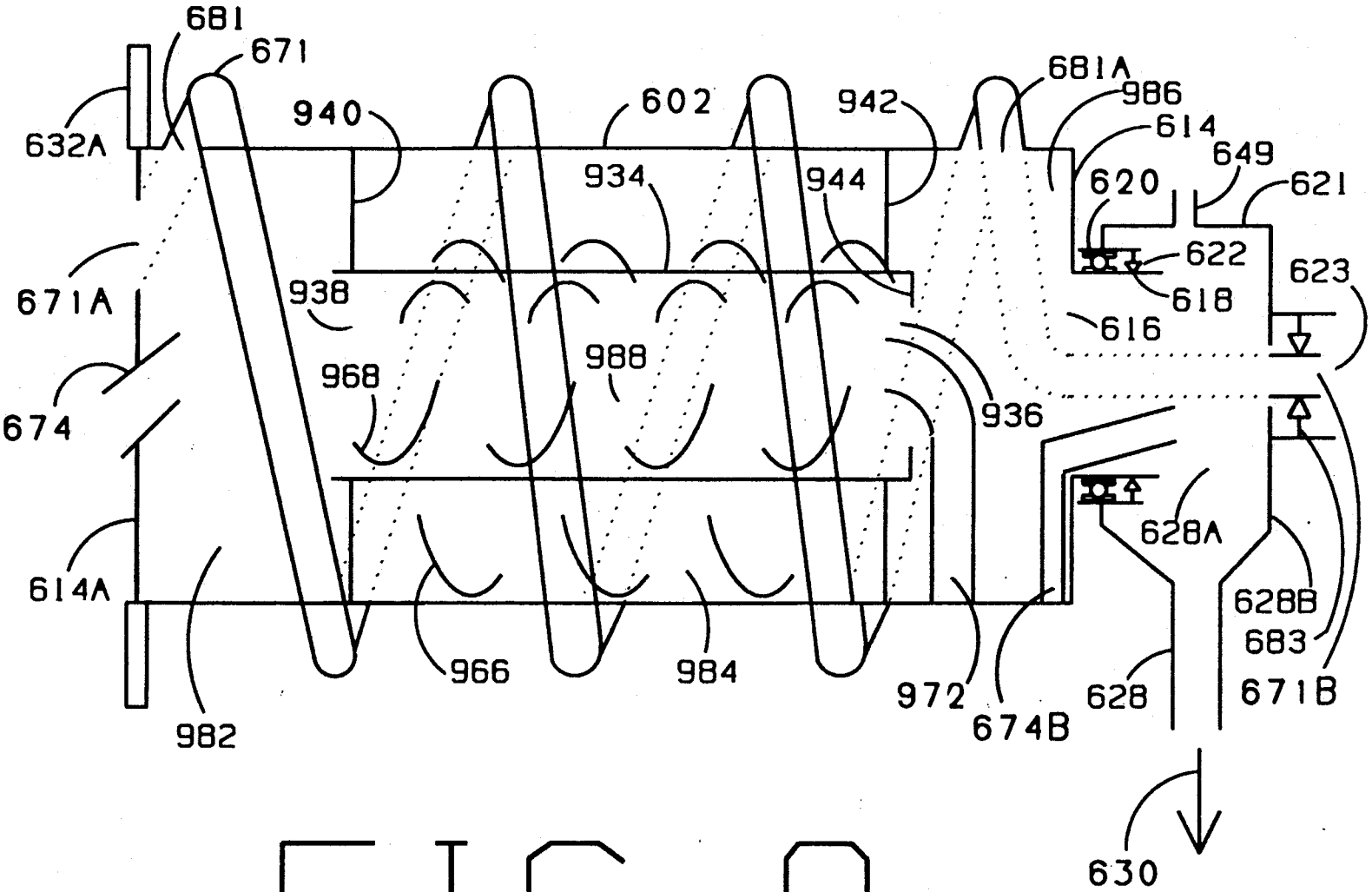
FIG. 9 is a cross-sectional schematic of the rear section of the apparatus of FIG. 6 that shows the rear section of FIG. 6 in more detail.

Referring now to FIG. 6, there is shown exchanger 600 having a horizontal rotating drum 602. To more clearly illustrate the invention, most of the internals of exchanger 600 are not shown in FIG. 6. The internals not shown in FIG. 6 that are used to move the material in the various sections of drum 602 are shown in FIGS. 7, 8, and 9. In FIG. 6, the part of exchanger 600 that is on the left hand side of the viewer of the drawing is called the front end of exchanger 600 and the part of exchanger 600 that is on the right hand side of the viewer of the drawing is called the rear end of exchanger 600. An annular plate 604A is positioned in the front half of drum 602. Plate 604A has an opening 636A in its center. An annular plate 614A is positioned in the rear half of drum 602. Exchanger 600 is therefore divided into sections. The front section of exchanger 600 starts at the very front end of exchanger 600 and extends to plate 604A. The mid-section of exchanger 600 starts at plate 604A and extends to plate 614A. The rear section of exchanger 600 starts at plate 614A and ends at the very rear end of exchanger 600.

The front end of drum 602 is closed by annular plate 604 and plate 604 has center opening 606 with tube 608 connected to plate 604 encircling opening 606 as shown. Bearing 610 and seal 612 are mounted in tube 608, with bearing 610 rotatably mounting drum 602 on collection tube 675, and seal 612 sealingly engaging the collection tube. An annular plate 675A closes the front end of tube 675 and an annular plate 675B closes the rear end of tube 675. Tube 675 also has an inlet opening 675D on the upper rear end of tube, 675 and an outlet opening 675E that opens in to outlet pipe 688 on the bottom front end.

A screw tube 624A starts on the outside of tube 675 and extends through plate 675A, plate 675B, the front section of exchanger 600, and through the hole in plate 604A to the mid-section of exchanger 600. Tube 624A forms an annular chamber 675C in tube 675 between the inside wall of tube 675, plates 675A and 675B and the outside wall of tube 624A. An inlet opening on the upper front end of tube 624A connects to feed pipe 624, and an outlet opening 606A opens into the mid-section of exchanger 600. Tube 624A is provided with an internal screw conveyor 625 to move feed from the inlet to the outlet of tube 624A. Screw 625 is connected to drive shaft 627 for turning screw 625, and drive shaft 627 is provided with seal 631 to prevent leakage from the inside of tube 624A to the outside. The driver for shaft 627 is not shown, it being understood that one can be provided by one skilled in the art.

The rear end of drum 602 is closed by annular plate 614 having a center opening 616 with a concentric tube 618 surrounding the opening. Tube 618 is rotatably supported in bearing 620 and sealingly engaged by seal 622. Bearing 620 and seal 622 are mounted in sealed bulkhead 621, which is provided with end plate 628B and forms chamber 628A. Chamber 628A opens into outlet pipe 628.

On the front end of the front section of drum 602 is scoop 674A positioned so that its outlet rotates over opening 675D as drum 602 rotates. Scoop 674A has small perforations in the inlet that are sized so that liquid and small material can pass into scoop 674A and be lifted up to opening 675D, but large carriers cannot. Scoops 674 and 674B are provided in the rear end of the mid-section and the rear end of the rear section respectively of drum 602. Scoops 674 and 674B are configured similar to scoop 174 used on exchanger 100 and previously described. Scoop 674 lifts small material, but not carriers, from the rear end of the mid-section to the front end of the rear section and scoop 674B lifts small material, but not carriers, from the rear end of the rear section to chamber 628A.

On the outside of drum 602, at the front end and the rear end of the mid section of drum 602, rotatable wheels 632 and 632A support drum 602 for rotation. Supporting and driving means to support and rotate wheels 632 and 632A are not shown, it being understood that such can be provided by one skilled in the art.

The mid-section of drum 602 is enclosed by jacket 650 that provides an annular chamber 652 between jacket 650 and drum 602 to carry a heat exchanging gas or other fluid for controlling the temperature of the outside on the mid-section of drum 602. Jacket 650 is provided with inlet tube 654, outlet tube 656, seal 662 between jacket 650 and front wheel 632, and seal 664 between jacket 650 and rear wheel 632A.

On the outside of the rear section of drum 602 a condensing tube 671 is provided to condense vapors from inside of the mid-section of drum 602. Tube 671 starts at opening 671A in plate 614A and extends through the front part of the rear section of drum 602 to the outside of drum 602 through opening 681. Tube 671 is wound in a helix around the outside of the rear section of drum 602 to the rear end of the rear section of drum 602 where it continues back to the inside of the rear section of drum 602 through opening 681A and continues through the center of tube 618 and through the center of plate 628B providing outlet 671B. Outlet 671B is provided with seal 683 between it and plate 628B to seal chamber 628A from the outside.

Drum 602 is integrally attached to tubes 608 and 618 by plates 604 and 614, and scoops 674A, 674, and 674B, section plates 604A and 614A, drive wheels 632, and 632A, and pipe 671 are affixed thereto. Those components therefore rotate together as one piece. However, collection tube 675 with outlet pipe 628, and screw tube 624A with screw 625 and inlet pipe 624, jacket 650, and bulkhead 621 with connecting pipes 649 and 628 do not rotate.

The temperature of the outside of the mid-section of drum 602 is controlled by the temperature of the gas, or liquid, that flows through inlet pipe 654, as shown by arrow 660, and through chamber 652, as shown by arrow 652A, and out of outlet pipe 658, as shown by arrow 658. Alternately, a direct fire can be placed in chamber 652, but in hot service, hot gas as described in my U.S. Pat. No. 4,872,954, issued Oct. 10, 1989, is preferred.

Feed consisting of solids and liquids from inlet pipe 624 flows to tube 624A and is conveyed by screw conveyor 625 through opening 606A to the front of the mid section of drum 602. The feed is heated from the walls of the mid-section of drum 602 and the liquids vaporized. The vapors from the mid-section of drum 602 flow to the front section through opening 636A in plate 604A. The outside walls of the front section of drum 602 are cooled by one of the methods previously taught, so the vapors from the mid-section are cooled in the front section and condensed. In rotating with drum 602, scoop 674A lifts the liquids from the bottom of the front end of the front section of drum 602 and moves it to opening 675D. The liquids, and non-condensable gases, then flow through chamber 675C and opening 675E to outlet pipe 688.

The solids from the feed are further heated as they flow through the mid-section to the rear end of the mid-section where they are lifted and moved by scoop 674 to the front end of the rear section of drum 602. The outside of the rear section is cooled by a method previously taught so the solids are cooled as they move to the rear end of the rear section to scoop 674B which lifts the solids and moves them to chamber 628A and then they flow by gravity to outlet pipe 628.

Attention is directed to the fact that although the feed is heated in the mid section to very high temperatures, with the heating medium often being between 1000 and 2000 degrees F., seals 612 and 622 operate at relatively low temperatures. In fact, the seals can easily be operated at between 200 and 600 degrees F., but it is preferred that the solids are not cooled too much so seal 622 should operate at between 220 and 475 degrees F. If the solids are cooled too much, undesirable vapors from the mid-section may condense on the solids. To prevent this, the solids are only cooled to a temperature above that of steam at the operating pressure of the exchanger, and steam is injected in pipe 649 and flows through the rear section and back to the mid-section. This prevents undesirable vapors from flowing from the mid-section to the rear section of exchanger 600.

Some feeds have an excessive amount of liquids that vaporize at a relatively high temperature, such as between 500 and 1000 degrees F. Such vapors tend to recondense on the feed at the front end of the mid-section and tend to cause a flow problem of the vapors inside of the mid-section. Accordingly, it is sometimes desirable to remove vapors from both the front and the rear ends of the mid-section. Therefore, pipe 671 is optionally provided to additionally remove vapors from the rear end of the mid section of drum 602. Vapors flow to pipe 671 through opening 671A. The vapors are cooled by contact with the walls of the pipe on the outside of the cold rear section of drum 602. The vapors condense inside of cold pipe 671 and the liquids are carried to the rear end and flow out outlet 671B.

The mid-section of exchanger 600 is shown in more detail in FIG. 7. An interior cylindrical drum 734 is coaxially disposed in the mid-section of drum 602 to form an annular passage 784 between the mid-section of drum 602 and drum 734. Rods 740 attach the outside of the front end of drum 734 to the inside of drum 602 and rods 742 attach the outside of the rear end of drum 734 to the inside of drum 602 so that drum 734 rotates with drum 602 when drum 602 rotates. Drum 734 has an opening 738 on the front end and a ring 744 with an opening 736 on the rear end. A chamber 786 is located on the rear end of the mid-section of drum 602.

Inside of chamber 784 is a freely rotating helix 766 that touches the bottom inside of drum 602 and helixs around the outside of drum 734 but does not touch drum 734. Helix 766 is located between rods 740 and 742 and is allowed to rotate freely inside drum 602 as drum 602 rotates. Rotating helix 766 is configured to move material from the front end of the mid-section of drum 602 to the rear end of the mid-section of drum 602.

Inside of drum 734 is a freely rotating helix 768 that touches the bottom inside of drum 734 and is allowed to rotate freely inside of drum 734 as drum 734 rotates. Rotational helix 768 is configured to move material from the rear end of drum 734 to the front end of drum 734.

Annular ring 746 positioned on the inside front portion of drum 602 partially closes the front end of the annular passage 784 between the rods 740 and plate 604A and provides chamber 782 in the inside front end of the mid-section of drum 602.

Carrier scoop 772, similar to carrier scoop 172 previously described in exchanger 100, is positioned in chamber 786 and is connected to the inside of drum 602 and extends to the inside of drum 734 through opening 736. The entrance of carrier scoop 772 is perforated so that it allows small material to pass through scoop 772 but the perforations are small enough so that the carriers will not pass through them but are lifted up and placed in the inside of drum 734 as drum 602 rotates. Material scoop 674, similar to scoop 174 in FIG. 1 which has been previously described, is provided in chamber 786 to lift small material, but not the carriers, from the rear end of the mid section to the front end of the rear section of drum 602.

There is a scoop 776 in chamber 782 configured to lift carriers and material over ring 746 from chamber 782 to chamber 784. Scoop 776 is sized so that an excessive amount of carriers and material are not lifted from chamber 782 to chamber 784 so that chamber 782 always contains a substantial amount of carriers and material.

In operation of the mid-section of exchanger 600 as shown by FIG. 7, the drum is rotated by wheels 632 and 632A, heat is applied to the outside of drum 602 by chamber 652 and feed is conveyed to chamber 782 from tube 624A by internal screw 625, all as previously shown in FIG. 6 and described above. Chamber 782 serves as a holding chamber that utilizes the carriers to grind pulverize, and exchange heat to the feed. The flow of hot carriers to chamber 782 is such that most of the vaporization takes place in chamber 782. The vapors flow from chamber 782 through opening 636A to the front section of drum 602.

The feed and carriers in chamber 782 are lifted over ring 746 to chamber 784 by scoop 776 where they are pushed by helix 766 through chamber 784 to chamber 786. In chamber 784 they are further heated and any remaining liquids are vaporized and the vapors flow back to chamber 782 and the solids are pushed on to chamber 786.

Chamber 786 also is a holding chamber that utilizes the carriers to grind, pulverize and exchange heat to the feed. Scoop 674 in chamber 786 lifts the small solids, but not the carriers, from chamber 786 through the hole in plate 614A to the front end of the rear chamber. Scoop 772 in chamber 786 lifts the carriers , but not the small solids, to chamber 788, through opening 736 of drum 734. Ring 744 prevents the carriers from falling back to chamber 786 before helix 768 can receive them and move them down drum 734. Helix 768 moves the carriers from the rear end of drum 734 to the front end of drum 734 and back to chamber 782. The carriers are further heated as they move down drum 734.

Therefore, the carriers serve to clean the walls of the inside of drums 602 and 734, and chambers 782 and 786 and also to transfer heat to the feed and to grind and pulverize the feed in chambers 782 and 786.

The front section of exchanger 600 of FIG. 6 is shown in more detail in FIG. 8. An interior cylindrical drum 834 is coaxially disposed in the front section of drum 602 to form an annular passage 884 between the inside wall of drum 602 and the outside wall of drum 834. Rods 840 attach the outside of the front end of drum 834 to the inside of drum 602 and rods 842 attach the outside of the rear end of drum 834 to the inside of drum 602 so that drum 834 rotates with drum 602 when drum 602 rotates. Drum 834 has an opening 836 on the rear end and a ring 844 with an opening 838 on the front end. Tube 624A extends through the inside of drum 834 and forms a chamber 888 between the outside wall of 624A and the inside wall of 834.

There is also a chamber 886 located on the rear end of the front section of drum 602.

Inside of chamber 884 is a freely rotating helix 866 that touches the bottom inside of drum 602 and surrounds but does not touch drum 834. Helix 866 is located between rods 840 and 842 and is allowed to rotate freely inside drum 602 as it rotates. Rotating helix 866 is configured to move material from the rear end of the front section of drum 602 to the front end of the front section of drum 602.

Inside of chamber 888 is a freely rotating helix 868 that touches the bottom inside of drum 834 and is allowed to rotate freely inside of drum 834 as drum 834 rotates. Rotational helix 868 is configured to move material from the front end of drum 834 to the rear end of drum 834.

Chamber 882 is provided on the front end of the front section of drum 602 between rods 840 and plate 604. Carrier scoop 872, similar to carrier scoop 172 previously described in exchanger 100, is positioned in chamber 882 and is connected to the inside of drum 602 and extends to the inside of drum 834 through opening 838. The walls of carrier scoop 872 are perforated to allow small material to pass through them, but the perforations are small enough so that the carriers will not pass through them but are lifted up and placed in the inside of drum 834 as drum 602 rotates.

In operation of the front section of exchanger 600 as shown by FIG. 8, the drum is rotated by wheels 632 and 632A and feed is conveyed to chamber 782 in the mid section from tube 624A, by screw 625, all as previously shown in FIG. 6 and described above. The vapors from the mid-section flow to the front section through opening 636A.

The carriers in chamber 882 are lifted to the inside of chamber 888 over ring 844 where they are pushed by helix 868 through chamber 888 to chamber 886. Chamber 886 also is a holding chamber that utilizes the carriers to exchange heat with the vapors and to grind any dust or waxes that are carried over with the vapors. Helix 866 pushes the carriers from chamber 886 through chamber 884 and back to chamber 882.

Therefore, the carriers serves to clean the walls of the inside of drums 602 and 834, and chambers 882 and 886 and also to transfer heat from the vapors.

The front section of exchanger 600 of FIG. 6 is shown in more detail in FIG. 8. Referring to FIG. 8, there is shown the front section of drum 602 with ring 632, plates 604A and 604 with tube 608, bearing 610, and seal 612, tube 624A with screw 625 and inlet pipe 624, collection tube 675 with plates 675A, 675B, chamber 675C, inlet opening 675D and outlet opening 675E and scoop 674A. All of those items are shown in FIG. 6 and are described above.

In FIG. 8, there is an interior cylindrical drum 834 being coaxially disposed in the front section of drum 602 to form an annular passage 884 between the inside wall of drum 602 and the outside wall of drum 834. Rods 840 attach the outside of the front end of drum 834 to the inside of drum 602 and rods 842 attach the outside of the rear end of drum 834 to the inside of drum 602 so that drum 834 rotates with drum 602 when drum 602 rotates. Drum 834 has an opening 836 on the rear end and a ring 844 with an opening 838 on the front end. Tube 624A extends through the inside of drum 834 and forms an annular chamber 888 between the outside wall of 624A and the inside wall of 834.

Inside of chamber 884 is a freely rotating helix 866 that touches the bottom inside of drum 602 and helixs around the outside of drum 834 but does not touch drum 834. Helix 866 is located between rods 840 and 842 and is allowed to rotate freely inside drum 602 as drum 602 rotates. Rotating helix 866 is configured to move material from the rear end of the front section of drum 602 to the front end of the front section of drum 602.

Inside of chamber 888 is a freely rotating helix 868 that touches the bottom inside of drum 834 and is allowed to rotate freely inside of drum 834 as drum 834 rotates. Rotational helix 868 is configured to move material from the front end of drum 834 to the rear end of drum 834.

Chamber 882 is provided on the front end of the front section of drum 602 between rods 840 and plate 604. Carrier scoop 872, similar to carrier scoop 172 previously described in exchanger 100, is positioned in chamber 882 and is connected to the inside of drum 602 and extends to the inside of drum 834 through opening 838. Carrier scoop 872 is perforated so that it allows small material to pass through scoop 872 but the perforations are small enough so that the carriers will not pass through them but are lifted up and placed in the inside of drum 834 as drum 602 rotates.

In operation of the front section of exchanger 600 as shown by FIG. 8, the drum is rotated by wheels 632 and 632A and feed flows to chamber 782 in the mid-section from tube 624A, all as previously shown in FIG. 6 and described above. The vapors from the mid-section flow to the front section through opening 636A.

The carriers in chamber 882 are lifted to the inside of chamber 888 over ring 844 where they are pushed by helix 868 through chamber 888 to chamber 886. Chamber 886 also is a holding chamber that utilizes the carriers to exchange heat with the vapors and to grind any dust or waxes that are carried over with the vapors. Helix 866 pushes the carriers from chamber 886 through chamber 884 and back to chamber 882. Therefore, the carriers serve to clean the walls of the inside of drums 602 and 834 and chambers 882 and 886 and also to transfer heat to the feed.

The rear section of exchanger 600 of FIG. 6 is shown in more detail in FIG. 9. Referring to FIG. 9, there is shown the rear section of drum 602 with wheel 632A, plates 614A and 614 with tube 618, bearing 620, and seal 622, condenser pipe 671, scoop 674B, and bulkhead 621 With connecting pipes 628 and 649. All of those items are shown in FIG. 6 and are described above.

In FIG. 9, there is an interior cylindrical drum 934 coaxially disposed in the rear section of drum 602 to form an annular passage 984 between the inside wall of drum 602 and the outside wall of drum 934. Rods 940 attach the outside of the front end of drum 934 to the inside of drum 602 and rods 942 attach the outside of the rear end of drum 934 to the inside of drum 602 so that drum 934 rotates with drum 602 when drum 602 rotates. Drum 934 has a ring 944 with an opening 936 on the rear end. There is also a chamber 986 located on the rear end of the rear section of drum 602.

Inside of chamber 984 is a freely rotating helix 966 that touches the bottom inside of drum 602 and helixs around the outside of drum 934 but does not touch drum 934. Helix 966 is located between rods 940 and 942 and is allowed to rotate freely inside drum 602 as drum 602 rotates. Rotating helix 966 is configured to move material from the front end of the rear section of drum 602 to the rear end of the rear section of drum 602.

Inside of chamber 988 is a freely rotating helix 968 that touches the bottom inside of drum 934 and is allowed to rotate freely inside of drum 934 as drum 934 rotates. Rotational helix 968 is configured to move material from the rear end of drum 934 to the front end of drum 934.

Chamber 986 is provided on the rear end of the rear section of drum 602 between rods 940 and plate 614. Carrier scoop 972, similar to carrier scoop 172 previously described in exchanger 100, is positioned in chamber 986 and is connected to the inside of drum 602 and extends to the inside of drum 934 through opening 936. Carrier scoop 972 is perforated so that it allows small material to pass through its walls but the perforations are small enough so that the carriers will not pass through them but are lifted up and placed in the inside of drum 934 as drum 602 rotates.

In operation of the rear section of exchanger 600 as shown by FIG. 9, the drum is rotated by wheels 632 and 632A and hot solids flows to chamber 982 from the mid-section through scoop 674, all as previously shown in FIG. 6 and described above.

The carriers in chamber 986 are lifted to the inside of chamber 988 over ring 944 where they are pushed by helix 968 through chamber 988 to chamber 982. Chamber 982 also is a holding chamber that utilizes the carriers to exchange heat with the vapors and to grind any lumps that are carried over by scoop 674. Helix 966 pushes the carriers from chamber 982 through chamber 984 and back to chamber 986. Therefore, the carriers serves to clean the walls of the inside of drums 602 and 934 and chambers 986 and 982 and also to transfer heat from the solids to the walls of the rear end of drum 602.

Since the outside of the rear end of drum 602 is being cooled by one of the methods previously taught, the hot solids are cooled as they flow through chamber 984 to chamber 986. In chamber 986, the solids, but not the carriers, which have been cooled by flowing through chamber 984, are lifted up and placed into chamber 628A where they flow by gravity to outlet pipe 628.

(d) Means for Handling Expansion and Misalignment of the Apparatus of FIG. 6.

In some instances, the long length of drum 602 and the high temperatures that the mid-section operates under causes excessive expansion of drum 602 and sometimes misalignment of its ends. The following structure is provided to handle such expansion and misalignment.

Figure 10:
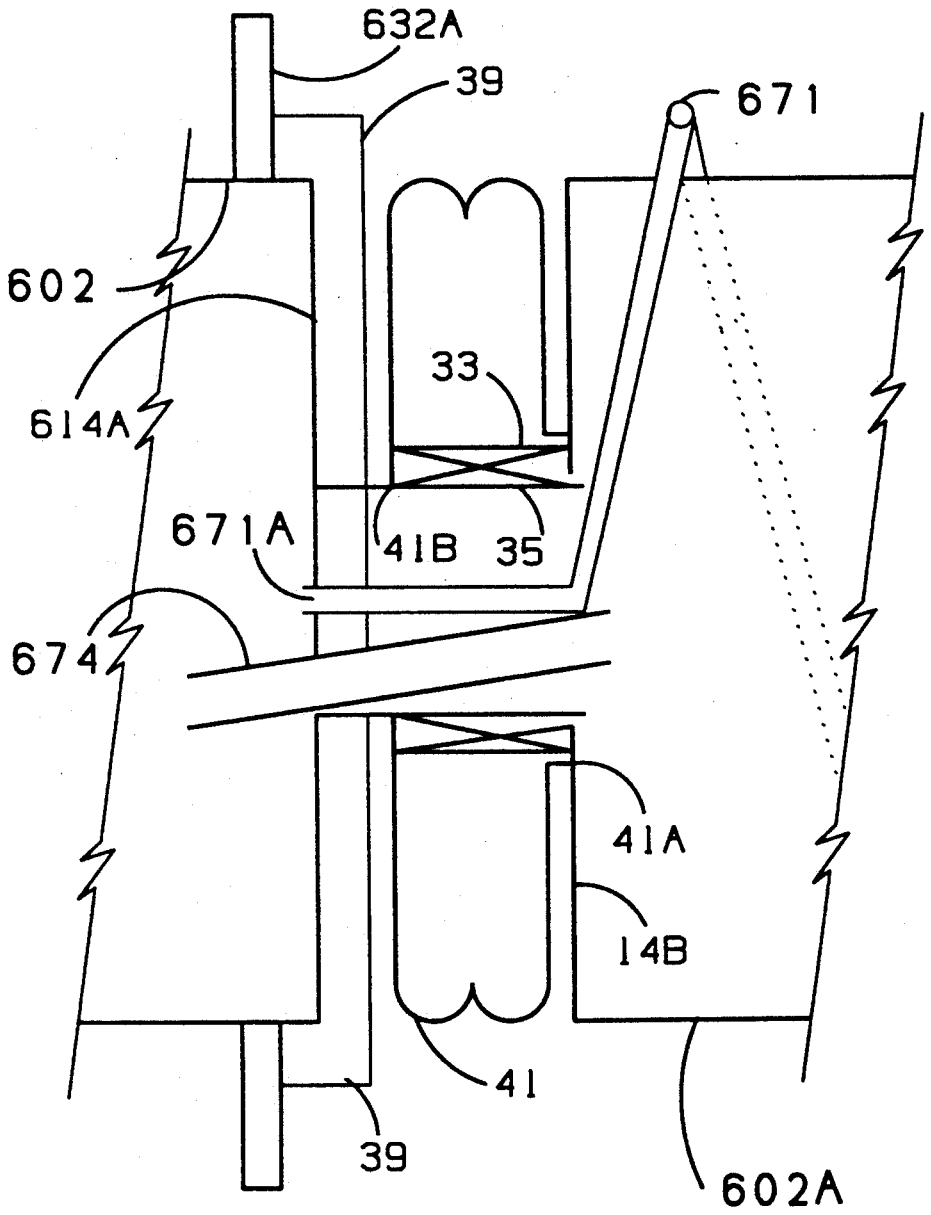
FIG. 10 is a fragmentary cross-sectional schematic of another embodiment of the invention.

Referring now to FIG. 10, there is shown a portion of the rear end of the mid-section of drum 602 of FIG. 6. The front portion of the mid-section of drum 602 is not shown in FIG. 10. Plate 614A, wheel 632A, and a portion of condensing pipe 671 and scoop 674 of FIG. 6 is shown in FIG. 10.

The portion of drum 602 that is the rear section of FIG. 6 is called 602A in FIG. 10. The front end of the rear section of drum 602A is enclosed by plate 14B having a hole in its center.

Tube 35 is concentrically affixed to the center of plate 614A and extends through the hole in plate 14B to the front end of the rear section 602A of drum 602. Scoop 674 and pipe 671 extend from the rear end of the mid-section of drum 602, through a hole in plate 614A, through tube 35 and to the front end of the rear section and drum 602A.

The hole in plate 14B is large enough to let tube 35 protrude thru it and to let plate 14B move and slide on tube 35, but it is small enough to substantially centrally support plate 14B.

Expansion joint 41 is provided and is attached to tube 35 at 41B and to plate 14B at 41A. The expansion joint 41 flexes and absorbs the expansion and movement of drum 602 and therefore bearing 620 (shown in FIG. 6) can be held rigidly in place to support the rear end of the rear section of drum 602A. The outside of plate 614A is provided with insulation 39 to retain heat in the mid section.

Flexible packing 33 is provided around the outside of tube 35, inside expansion joint 41 and next to plate 14B to plug the space between plate 14B and tube 35 and prevent excessive matter from getting inside the expansion joint.

It should be noted that there may be many modifications to the expansion joint of FIG. 10 without departing from the spirit of the present invention, but, with an expansion joint between the various sections of drum 602 of FIG. 6, many other sections can be attached to drum 602 that can provide many combinations of heating and cooling.

Although the invention is described with respect to a specific embodiment, modifications thereof can be made by one skilled in the art without departing from the spirit of the invention and the details hereof are not to be construed as limitations, except to the extent indicated in the following claims.

What is claimed is:

1. A retort, comprising:

a drum mounted for rotation about a substantially horizontal axis, means dividing said drum into first, second and third coaxial sections with the second section intermediate the first and third sections, an outer heat exchange surface on each of said sections, the heat exchange surfaces of the first and third sections being positioned for contact by a cooling medium, means for applying a cooling medium to the outer heat exchange surfaces of the first and third sections, means for heating the heat exchange surface of said second section, means for feeding a material containing solids and liquids into said second section for vaporizing at least some of the liquids and heating at least some of the solids, means defining a passageway between the first and second sections positioned to allow movement of vaporized material from the second section to the first section for condensing at least some of the vaporized material in said first section, means for moving heated solids from the second section to the third section for cooling the solids in said third section, means defining a passageway from the first section for removing liquids and non-condensable gas from the first section, and means for removing the solids from the third section.

2. A retort as defined by claim 1 and including a rotary seal between the feeding means and one end of the drum and a rotary seal between the removing means and the other end of the drum.

3. Apparatus for separating fluids from a feed stock containing solids comprising a rotatable drum, means dividing said drum into a central heating section and a coaxial cooling section on each end of the central heating section, feed means for supplying feed stock to the heating section, means for moving the feed stock through the heating section for heat treatment to separate fluids from solids, means for moving heated solids from the heating section to one of said cooling sections, means defining a passageway between the heating section and the other of said cooling sections positioned to allow movement of vaporized material to said other of said cooling sections, removal means in communication with at least one of said cooling sections for removing products of heat treatment from the drum, and means for applying a coolant to the first and third sections to cool said products before removal from the drum.

4. A heat exchanging apparatus comprising:

a cylindrical outer drum mounted for rotation about a substantially horizontal axis, said drum having an outer, heat exchange surface, a cylindrical inner drum concentrically mounted within said outer drum for rotation therewith, said inner drum being open at both ends, and the ends of said inner drum terminating short of the ends of said outer drum, an inlet opening in one end of said outer drum, a material feed tube for feeding material including particulate material extending into said outer drum through said central inlet opening and terminating near said one end so that material fed into said outer drum is deposited near said one end, an outlet opening in the other end of said outer drum, a freely rotating helix with its axis substantially parallel with the axis of said outer drum, carried within and on the inner surface of the lower side of said outer drum and surrounding said inner drum, said helix being coiled to convey material toward the other end of the outer drum, means for transferring particles larger than a predetermined size from the other end of the outer drum to the other end of the inner drum, means for removing particles smaller than the predetermined size from the other end of the outer drum, a freely rotating helix with its axis substantially parallel with the axis of said inner drum, carried within and on the inner surface of the lower side of said inner drum, said helix being coiled to convey particulate material toward the one end of said outer drum, whereby when said drums are rotated, material to be heat treated is conveyed longitudinally along the inner surface and toward the other end of said outer drum, larger particles are transferred to the inner drum and conveyed longitudinally along the inner surface of the inner drum toward the one end of said outer drum, and smaller particles are removed from the outer drum.

5. A heat exchanging apparatus as defined by claim 4, and including a coaxial cylindrical cooling chamber mounted on each end of said outer drum for rotation therewith, said means for removing particles smaller than the predetermined size from the other end of the outer drum including means for conducting said smaller particles to one of said cooling chambers, and means for conducting fluid materials from said outer drum to the other of said cooling chambers.

6. A heat exchanging apparatus comprising:

a cylindrical outer drum mounted for rotation about a substantially horizontal axis, said drum having an outer heat exchange surface, a cylindrical inner drum concentrically mounted within said outer drum for rotation therewith, said inner drum being open at both ends, and the ends of said inner drum terminating short of the ends of said outer drum, a central inlet opening in one end of said outer drum, a material feed tube for feeding material including particulate material extending into said outer drum through said central inlet opening and terminating near said one end so that particulate material fed into said outer drum is deposited near said one end, a central outlet opening in the other end of said outer drum, a freely rotating helix with its axis substantially parallel with the axis of said outer drum, carried within and on the inner surface of the lower side of said outer drum and surrounding said inner drum, said helix being coiled to convey material toward the other end of the outer drum, a first scoop mounted within said outer drum with an inlet opening between the other end of said outer drum and the adjacent end of the inner drum and adjacent the inner surface of said outer drum, and an outlet opening into the interior of said inner drum, said first scoop having perforations in its walls larger than particles of the material in the outer drum and smaller than carriers mixed with said material, a second scoop mounted within and adjacent to the other end of said outer drum with an inlet opening adjacent the inner surface of said outer drum, said opening being of a size to admit material particles to the second scoop but exclude carriers, and an outlet opening into the outlet opening of said outer drum, and a freely rotating helix with its axis substantially parallel with the axis of said inner drum, carried within and on the inner surface of the lower side of said inner drum, said helix being coiled to convey material toward the one end of said outer drum, whereby when said drums are rotated, material to be heat treated and carriers are conveyed longitudinally along the inner surface and toward the other end of said outer drum, the first scoop picks up carriers and deposits them in the inner drum, the carriers are conveyed longitudinally along the inner surface of the inner drum toward the one end of said outer drum, and the second scoop picks up material and deposits it into the outlet opening of the outer drum.

7. A heat exchanging apparatus comprising:

a cylindrical outer drum mounted for rotation about a substantially horizontal axis, said drum having an outer heat exchange surface, a cylindrical inner drum concentrically mounted within said outer drum for rotation therewith, said inner drum being open at both ends, and the ends of said inner drum terminating short of the ends of said outer drum, an inlet opening in one end of said outer drum, a material feed tube extending into said outer drum through said inlet opening and terminating near said one end so that material fed into said outer drum is deposited near said one end, an outlet opening in the other end of said outer drum, a scoop mounted within said outer drum with an inlet opening between the other end of said outer drum and the adjacent end of the inner drum;

a plurality of carriers in said outer drum, means in said outer drum for conveying said carriers and said material from said one end to said other end of said outer drum, means for transferring carriers from said outer drum to the inner drum at the end adjacent the other end of said outer drum, means for conveying carriers in said inner drum to the opposite end of said inner drum, and means for removing materials from the other end of said outer drum.

8. Apparatus for separating fluids from a feed stock containing solids comprising a rotatable drum, means dividing said drum into a central heating section and a coaxial cooling section on each end of the central heating section, feed means for supplying feed stock to the heating section, means for moving the feed stock through the heating section for heat treatment to separate fluids from solids, coaxial removal means for removing products of heat treatment from at least one section of the drum, a vapor coil around one of said cooling sections connected for receiving vapors from said heating section, condensing the vapors and disposing of the condensate outside of said drum, and seal means for sealing between the feed means and the drum and between the removal means and the drum.

9. Apparatus for separating fluids from a feed stock containing solids comprising a rotatable drum, means dividing said drum into a central heating section and a coaxial cooling section on each end of the central heating section, an expansion joint between the heating section and one of the cooling sections, coaxial feed means for supplying feed stock through one of said cooling sections to the heating section, means for moving the feed stock through the heating section for heat treatment to separate fluids from solids, coaxial removal means for removing products of heat treatment from at least one section of the drum, and seal means for sealing between the feed means and the drum and between the removal means and the drum.

10. Apparatus for separating fluids from a feed stock containing solids comprising a rotatable drum, means dividing said drum into a central heating section and a coaxial cooling section on each end of the central heating section, coaxial feed means for supplying feed stock through one of said cooling sections to the heating section, means for moving the feed stock through the heating section for heat treatment to separate fluids from solids, means defining a passageway between the heating section and one of the cooling sections positioned to allow movement of vapors from the heating section to said one cooling section, coaxial removal means for removing products of heat treatment from at least one section of the drum, a vapor coil around one of the cooling sections connected for receiving vapors from said heating section, condensing the vapors and disposing of the condensate outside of said drum, and seal means for sealing between the feed means and the drum and between the removal means and the drum.

11. A retort, comprising:

a drum mounted for rotation about a substantially horizontal axis, means dividing said drum into first, second and third coaxial sections, each section having an entrance end and an exit end, with the second section intermediate the first and third sections, the entrance end of the second section being adjacent the entrance end of the first section and the exit end of the second section being adjacent the entrance end of the third section, an outer heat exchange surface on each of said sections, the heat exchange surfaces of the first and third sections being positioned for contact by a cooling medium, means for applying a cooling medium to the outer heat exchange surfaces of the first and third sections, means for heating the heat exchange surface of said second section, means for feeding a material containing solids and liquids into said entrance end of said second section, means for moving said material from the entrance end of said second section to the exit end of said second section for vaporizing at least some of the liquids and heating at least some of the solids while moving through said second section, means for moving heated solids from said exit end of said second section into said third section for cooling at least some of the heated solids in said third section, means defining a passageway between said entrance end of said second section and said entrance end of said first section to allow movement of some vaporized material to said first section for cooling said vaporized material, a conduit positioned around a portion of said third section having a passageway in communication with said exit end of said second section and with the exterior of said drum to allow movement of other vaporized material from said exit end of said second section to the exterior of said drum, an outer heat exchange surface on said conduit positioned for contact by a cooling medium, means for applying a cooling medium to said conduit outer heat exchange surface for cooling said other vaporized material and condensing at least some of said other vaporized material, a first removal means for removing solid products of heat treatment from said third section, and a second removal means for removing vapors and liquid products of heat treatment from said first section

12. A retort as defined by claim 11 and including, a first seal means for sealing between the first removal means and the drum, a second seal means for sealing between the second removal means and the drum, and a third seal means for sealing between the feeding means and the drum.

* * * * *